US005335716A

United States Patent [19]

Takesue et al.

[11] Patent Number: 5,335,716

[45] Date of Patent: Aug. 9, 1994

[54] METHOD FOR STARTING CONTINUOUS CASTING IN CONTINUOUS SLAB CASTING AND METHOD FOR SETTING A DUMMY BAR PRIOR TO THE START OF CASTING OF CONTINUOUS SLAB CASTING

[75] Inventors: Hiromichi Takesue; Eiji Kameyama, both of Futtsu; Tsutomu Terada; Junichi Kawata, both of Kitakyushu, all of Japan

[73] Assignee: Nippon Steel Corporation, Tokyo, Japan

[21] Appl. No.: 997,884

[22] Filed: Dec. 29, 1992

[51] Int. Cl.[5] ..... B22D 11/04; B22D 11/08

[52] U.S. Cl. ..... 164/483; 164/491

[58] Field of Search ..... 164/483, 491, 425

[56] References Cited

FOREIGN PATENT DOCUMENTS

| | | |
|---|---|---|
| 312179 | 12/1973 | Austria . |
| 0114293 | 8/1984 | European Pat. Off. . |
| 2196212 | 3/1974 | France . |
| 52-148435 | 12/1977 | Japan . |
| 55-10391 | 1/1980 | Japan . |
| 3210953 | 9/1991 | Japan . |
| 2023045 | 12/1979 | United Kingdom . |
| 2094194 | 9/1982 | United Kingdom . |

*Primary Examiner*—Kuang Y. Lin

*Attorney, Agent, or Firm*—Wenderoth, Lind & Ponack

[57] ABSTRACT

A method for starting continuous slab casting capable of facilitating withdrawal of a dummy bar to start smooth continuous slab casting is provided at the start of casting of continuous slab casting, where lateral side plates 2 of the mold 10 are pinched by longitudinal side plates 1 of the mold and are adjustable in the slab width direction; where a dummy bar 4 is set at a desired level at the center in a width-variable, continuous casting mold; and clearances each between lateral side plates 2 and the dummy bar 4 are adjusted to 1–3 mm, while maintaining the lateral side plates 2 vertically, then sealing materials 5 are filled into the clearances; then molten steel is poured into the mold; and then the top ends of the lateral side plates 2 are made more apart outwardly, thereby giving a downwardly tapered profile to the lateral side plates 2, when no more poured molten steel is passed into the clearance between the formed solidified shell 6*a* and the plates 1 and 2, while withdrawing the dummy bar 4 downwardly; whereby the continuous slab casting is conducted.

24 Claims, 4 Drawing Sheets

METHOD FOR STARTING CONTINUOUS CASTING IN CONTINUOUS SLAB CASTING AND METHOD FOR SETTING A DUMMY BAR PRIOR TO THE START OF CASTING OF CONTINUOUS SLAB CASTING

BACKGROUND OF THE INVENTION

1) Field of the Invention

The present invention relates to a method for starting continuous casting in continuous slab casting and a method for setting a dummy bar prior to the start of casting of continuous slab casting.

2) Prior Art

When continuous slab casting is started in a conventional width-variable continuous casting apparatus by setting a dummy bar in a mold at the initial starting period of width-variable continuous slab casting apparatus, the following method has been so far employed.

FIG. 3(*a*) is a plan view schematically showing a width-variable mold used in the conventional continuous slab casting, and FIG. 3(*b*) is a vertical cross-sectional view along the line A—A of FIG. 3(*a*), where numeral 1 is longitudinal side plates of a mold 10, and 2 is lateral side plates of the mold. The lateral side plates 2 are moved in the width direction of a slab by pairs of upper and lower driving units 3*a* and 3*b* provided at the outsides of the lateral side plates 2 in such a manner that the lateral side plates 2 are tilted, while being pinched by the longitudinal side plates 1, and thereby to change or adjust the slab width dimension. In that case, the distance between the longitudinal side plates 1 is usually kept constant. When the slab thickness is to be changed, another procedure, for example, replacement of the lateral side plates 2 themselves, will be taken.

A procedure for starting the conventional continuous slab casting operations with the above-mentioned mold 10 will be explained below, referring to FIG. 3 and FIGS. 4(*a*) to 4(*d*).

In FIG. 4(*a*), when a dummy bar 4 is inserted from the upside or the downside of the mold 10, in order to facilitate its insertion, at first the driving units 3*a* and 3*b* are actuated to set positions of the top end sides of the lateral side plates 2 to a distance consisting of a desired distance (cast slab width+allowance for thermal shrinkage) and a distance for latitude, and thereby sufficiently broadening the distance between the lateral side plates 2, and then actuated to set the lateral side plates 2 to the desired distance. Or there is a case that from the beginning, the lateral side plates 2 are set to the desired distance and then the dummy bar 4 having a width 20–60 mm smaller than the distance between the lateral side plates 2 is inserted into the mold 10.

The inserted dummy bar 4 is set to a desired level at the center in the vertical direction in the mold 10, usually at a level $\frac{1}{3}$–$\frac{1}{2}$ of the total depth of the mold 10 distant from the bottom of the mold 10, and at the same time the bottom distance between the lateral side plates 2 is set to the desired width as the bottom, giving a downwardly tapered profile to the lateral side plates 2, as shown in FIG. 4(*b*).

The reasons why the lateral side plates 2 are set to take the downwardly tapered profile are that since a solidified shell formed in the mold undergoes a large shrinkage particularly in the width direction of a slab as cooling proceeds, clearances are formed between the lateral side plates 2 and the solidified shell 6*a*, and thus in view of slab heat shrinkage which may usually occur in the stationary casting state, the downwardly tapered profile is given to the lateral side plates 2, corresponding to the slab heat shrinkage, and thereby to narrow the distance at the bottom ends thereof.

On the other hand, usually no such downwardly tapered profile as given to the lateral side plates 2 is given to the longitudinal side plates 1, because the thickness of a cast slab is several fractions smaller than the width thereof and the slab heat shrinkage is thus smaller than that of the lateral side plates 2. It is also not necessary even in the insertion of a dummy bar 4 to give an allowance to the thickness, and the clearances between the dummy bar 4 and the longitudinal side plates 1 are kept to about 2–about 5 mm, which are indispensable for the working of the dummy bar 4.

At first, the dummy bar 4 is set to the inside of the mold 10 in this manner, and then heat-resistant sealing materials 5 having a good elasticity are filled into the clearances between the mold 10 and the dummy bar 4 to prevent leakage of molten steel therethrough.

Then, molten steel 6 is poured into the mold 10 from a tundish, as shown in FIG. 4(*c*). The poured molten steel is held in the mold 10 for about 40 seconds so that it can be withdrawn by the dummy bar 4, and cooled by the mold 10 during that time to form a solidified shell 6*a*.

A recess 4*a* is formed on the top surface of the dummy bar 4, and the molten steel is passed into the recess 4*a* and solidified therein to intensify the bondage between the dummy bar 4 and the slab, thereby making it possible to withdraw the slab by the dummy bar.

The molten steel 6 is continuously poured, while withdrawing the dummy bar 4 downwardly, as shown in FIG. 4(*d*), and the solidified shell 6*a* grows at the same time during the withdrawal to form a continuous cast slab.

In the unstationary state at the start of casting, the top of the dummy bar 4, the circumference of which has been filled with sealing materials 5, and the solidified shell 6*a* at the initial period of starting have a larger width than that of the bottom end of the mold 10, and thus a very large pulling force is required for passage of the dummy bar 4 through the bottom end of the mold 10 due to sliding of the dummy bar 4 or the solidified shell 6*a* on the mold 10. When the solidified shell 6*a* does not throughly grow in that case, the solidified shell 6*a* will be broken due to the friction on the mold 10, whereby the so-called break-out occurs and the bottom end of the mold 10 is damaged. As a result, such problems as a decrease in working time, a decrease in mold life, an increase in maintenance cost, etc. appear.

To solve these problems and obtain a strength of the solidified shell 6*a* large enough to withstand the large pulling force, it has been proposed to provide a sufficient time of holding the cast steel in the mold 10 or provide cooling materials 11 on, for example, the top surface of the dummy bar 4 in the mold 10, as shown in FIG. 4(*b*) to promote the formation and solidification of the shell 6*a*. However, these procedures have such new problems as an increase in preparatory time for the casting and operating cost and also making it hard to automate the casting operations. Furthermore, the lateral side plates 2 are in a profile of upwardly increasing distance in that case, and thus the total of the clearances between the top end of the dummy bar 4 and the wall of the mold 10 at both sides of the dummy bar 4 are as large as 20–45 mm, resulting in difficulty of filling the sealing materials 5. This means that there are still such problems as an increase in preparatory time for the casting and making it difficult to automate the casting operations.

SUMMARY OF THE INVENTION

The present invention has been accomplished to solve the afore-mentioned problems. A first object of the present invention is to provide a method for starting continuous slab casting, which can facilitate withdrawal of a dummy bar to smoothly start the continuous casting.

A second object of the present invention is to provide a method for setting a dummy bar in the continuous slab casting, which can facilitate filling of sealing materials and can ensure smooth withdrawal of a dummy bar and a slab at the initial period of casting.

The first object of the present invention can be attained by a method for starting continuous slab casting in a continuous casting mold, where lateral side plates of the mold are pinched by longitudinal side plates of the mold and are adjustable in the slab width direction, which method comprises setting a dummy bar in the mold to a desired level at the center in the vertical direction of the mold, adjusting clearances each between the lateral side plates and the dummy bar to 1–3 mm, while maintaining the lateral side plates vertically, then filling sealing materials into the clearances among the longitudinal side plates, the lateral side plates and the dummy bar, then starting to pour molten steel into the mold, holding the poured molten steel therein, while cooling the poured molten steel, thereby forming a solidified shell, then starting to withdraw the dummy bar downwardly, making the top ends of the lateral side plates more apart outwardly when no more molten steel passes into the clearances between the solidified shell and the plates, while withdrawing the dummy bar downwardly, thereby giving a downwardly tapered profile to the lateral side plates and conducting continuous casting of the molten steel.

The second object of the present invention can be attained by a method for setting a dummy bar in a continuous casting mold prior to the start of casting of continuous slab casting where lateral side plates of the mold are pinched by longitudinal side plates of the mold and are adjustable in the slab width direction, which method comprises adjusting a distance between the lateral side plates to a size at least 10 mm larger at each side than the width of the dummy bar, then inserting the dummy bar into the mold from the bottom or the top thereof, setting the dummy bar to a desired level at the center in the vertical direction of the mold, adjusting clearances each between the lateral side plates and the dummy bar to 1–3 mm, while maintaining the lateral side plates vertically, and then filling sealing materials into the clearance among the longitudinal side plates, the lateral side plates and the dummy bar, thereby setting the dummy bar in the continuous slab casting mold.

BRIEF DESCRIPTION OF THE DRAWINGS

FIG. 1(*b*) is a view showing that clearances between lateral side plates 2 of the mold 10 and the dummy bar 4 are adjusted to 1–3 mm, respectively, while holding the lateral side plates 2 vertically; FIG. 1(*c*) is a view showing that pouring of molten steel into the mold 10 is started to form a solidified shell 6*a* while elevating the surface level of the poured molten steel in the mold 10; and FIG. 1(*d*) is a view showing that the top ends of the lateral side plates 2 are moved outwardly to give a downwardly tapered profile to the lateral side plates 2, while continuing the continuous casting.

FIG. 4(*b*) is a view showing that a downwardly tapered profile is given to lateral side plates 2; FIG. 4(*c*) is a view showing that pouring of molten steel into the mold 10 is started to form a solidified shell 6*a* while elevating the surface level of the poured molten steel in the mold 10; and FIG. 4(*d*) is a view showing that the slab is withdrawn downwardly by the dummy bar 4 while pouring the molten steel into the mold 10, thereby continuing continuous casting.

DETAILED DESCRIPTION OF THE INVENTION

Figure 1A:
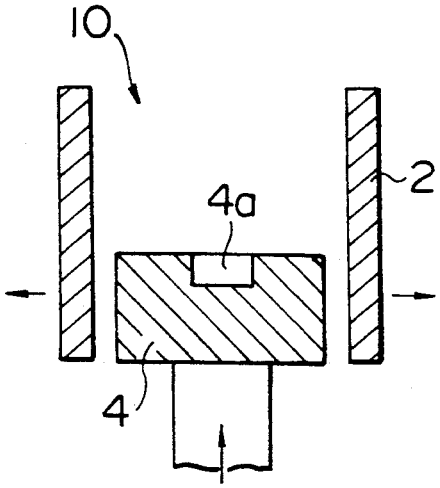
FIGS. 1(*a*) to 1(*d*) are schematic vertical cross-sectional views showing one embodiment of the operating procedure according to the present method for starting continuous slab casting, where FIG. 1(*a*) is a view showing that a dummy bar 4 is inserted in a mold 10.
Figure 1B:
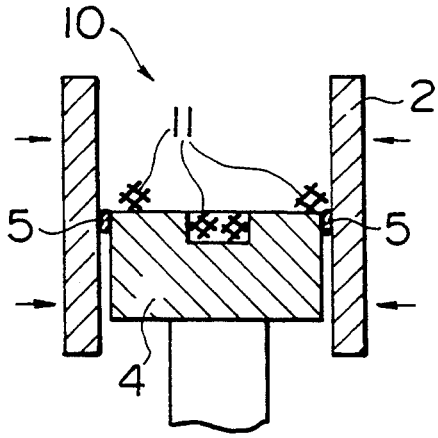
Figure 1C:
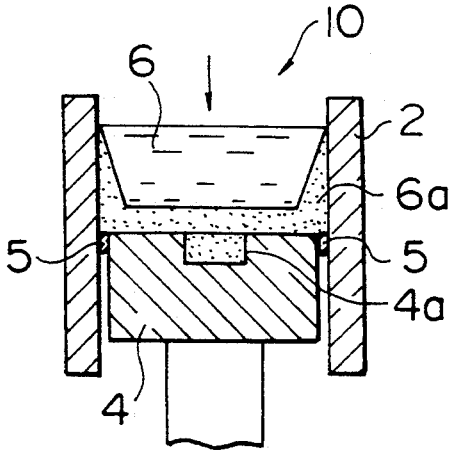
Figure 1D:
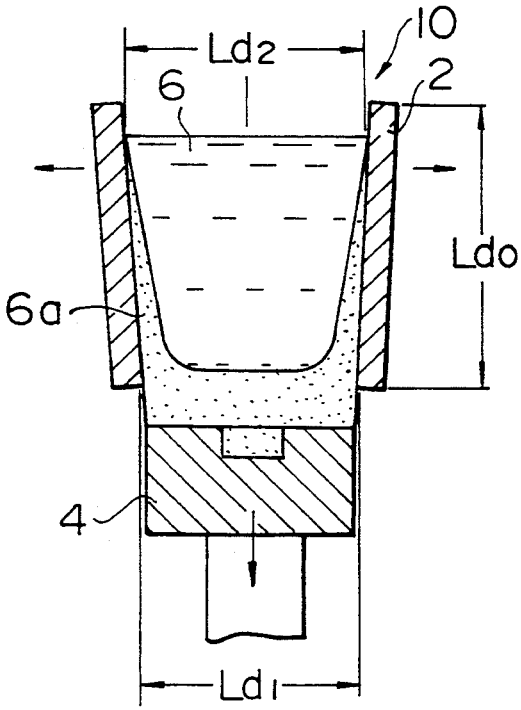

The present invention will be described below in detail together with functions, referring to FIGS. 2(*a*) and 2(*b*) showing a width-variable mold and FIGS. 1(*a*) to 1(*d*) showing one embodiment of a method for starting continuous slab casting according to the present invention.

As shown in FIG. 1(*a*), the distance between the lateral side plates 2 is adjusted to a size at least 10 mm larger at each side than the width of the dummy bar 4. In case of a mold directed to continuous casting of a flat slab with a large width, it is difficult to insert the dummy bar into the mold, when there is not a sufficient allowance particularly in the mold width direction. An allowance for the distance between each of the lateral side plates 2 and the dummy bar 4 in the mold width direction is preferably about 25–about 45 mm at each side.

Then, as shown in FIG. 1(*b*), the dummy bar 4 is inserted into the mold 10 from the bottom thereof and set to a desired level at the center in the vertical direction of the mold in the mold, for example, to a position $\frac{1}{3}$–$\frac{1}{2}$ of the mold depth from the bottom end of the mold 10.

Then, clearances each between the lateral side plates and the dummy bar 4 are adjusted to 1–3 mm, while maintaining the lateral side plates 2 vertically. Then sealing materials 5 are filled into clearances among the longitudinal side plates 1, the lateral side plates 2 and the dummy bar 4. As already mentioned above, clearances each between the dummy bar 4 and the longitudinal side plates 1 are kept to about 2–about 5 mm.

It is preferable that the clearances among the dummy bar 4 and the plates I and 2 are smaller in view of the leakage of molten steel and ease in the filling operation of sealing materials 5, and at least about 1–about 3 mm is required for each of the clearances in view of smooth withdrawal of the dummy bar 4.

Sealing materials 5 for use in the present invention include, for example, heat-resistant sealing materials having appropriate plasticity and viscosity, prepared by adding a powder of refractory materials, which comprise $SiO_2$, $Al_2O_3$ and CaO as main components, and silicon resin-based heat-resistant binder and kneeding these components, such as Gritter CC100 (trademark).

Setting of the dummy bar 4 is completed by the foregoing operations, and then, as shown in FIG. 1(*c*), molten steel 6 is poured into the mold 10 from a tundish. The poured molten steel is held in the mold for 10 to 30 seconds, preferably for about 15–about 20 seconds, so that solidified shell 6*a* formed from the poured molten steel by cooling can be withdrawn from the mold 10 by the dummy bar 4. During the pouring, the surface level of the poured molten steel is elevated in the mold 10 and the poured molten steel is cooled in the mold 10 to form the solidified shell 6*a*.

As mentioned above, the method of the present invention can decrease the holding time as compared with the conventional methods. Because the present method starts casting without giving the downwardly tapered profile in the initial starting period of casting, and thus the frictional force imparted from the lateral side plates kept in contact with the shell becomes smaller, the strength of the shell of the present invention may be weaker than that of the conventional shells, and thus the force to withdraw is decreased and the force imparted to the shell is decreased.

A recess 4*a* is formed on the top surface of the dummy bar 4 and the molten steel is passed also into the recess and solidified therein. The slab can be more tightly bonded to the dummy bar 4 thereby, and withdrawal of the slab by the dummy bar 4 can be facilitated.

Then, as shown in FIG. 1(*d*), the molten steel 6 is continuously poured into the mold 10, while withdrawing the dummy bar 4 downwardly. When no more molten steel is passed into the clearances each between the thus formed, solidified shell 6*a* and the lateral side plates 2 in that case after the start to withdraw the dummy bar 4 [for example, in case that the casting is carried under the conditions of steel species, bath temperature, width of casting and casting speed (0.4 m/min) which are described in the later-mentioned Example, 60 seconds after the start to withdraw the dummy bar 4, or before or after the passage of the dummy bar 4 through the bottom end of the mold 10, preferably after the passage thereof], the movement to give a downwardly tapered profile to the lateral side plates 2 is started and finally the top ends of the lateral side plates 2 (or both the top ends and the bottom ends thereof) are made more apart by about 1% (i.e. about 0.5% per each of the lateral side plates 2) in the distance (interval) therebetween by taking the heat-shrinkage caused in the stationary state into consideration, thereby to give the downwardly tapered profile to the lateral side plates 2. Thus, when the top end of the dummy bar proceeds downwardly to a position about 1/5 of the mold depth up from the bottom end of the mold or lower after the start to withdraw the dummy bar, the top ends of the lateral side plates start to be made more apart outwardly, thereby giving a downwardly tapered profile to the lateral side plates, and conducting the continuous casting. The description "When no more molten steel is passed into the clearances each between the thus formed, solidified shell 6*a* and the lateral side plates 2, the movement to give a downwardly tapered profile is started, thereby to give the downwardly tapered profile" means that the downwardly tapered profile is given under the conditions which do not cause the operating troubles of the following (1) and (2) on and after the start to withdraw, and it also means that when the strength of the thus formed, solidified shell attains a degree that changing of the downwardly tapered profile is carried out without causing trouble (to a degree that the thus formed, solidified shell can be maintained), the movement to give the downwardly tapered profile is started, thereby to give the downwardly tapered profile.

(1) There is a possibility such that when the start to give the downwardly tapered profile is made too early after the withdrawal is started (or when the downwardly tapered profile is given immediately after the withdrawal is started), the molten steel is passed into or flows into the clearances each between the solidified shell 6*a* and the lateral side plates 2 at the top end of the solidified shell 6*a*, and finally the shell is broken. Therefore, it is necessary to start the movements to give the downwardly tapered profile from the time when the slab has the speed to withdraw to a certain degree and give the downwardly tapered profile.

Figure 2A:
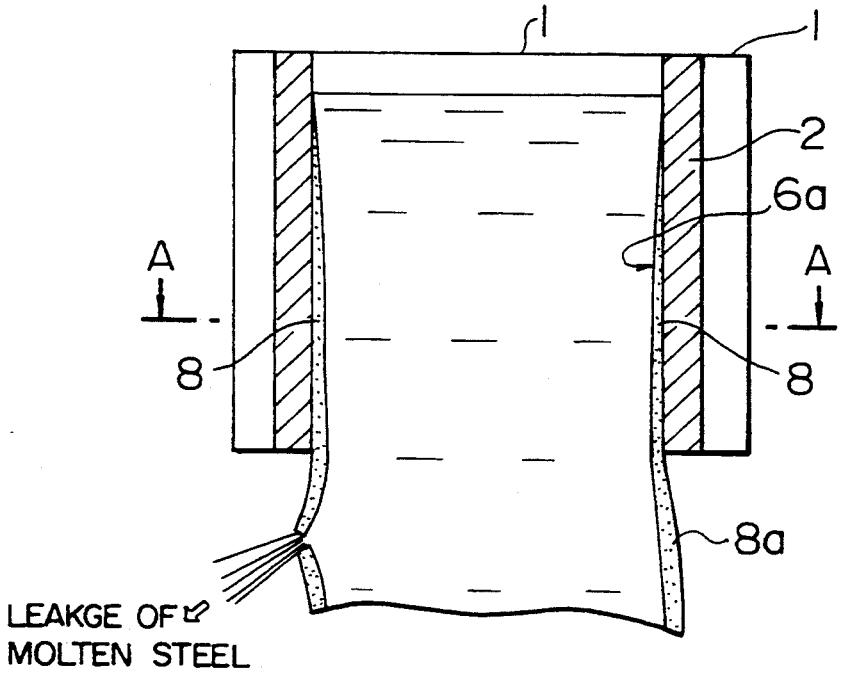
FIG. 2*a* is a schematic vertical cross-sectional view along the line B—B of FIG. 2(*b*) and shows a state of a mold according to the present invention in case that after starting to withdraw the slab, it is too late to start to move the lateral side plates 2 outwardly to give a downwardly tapered profile thereto.
Figure 2B:
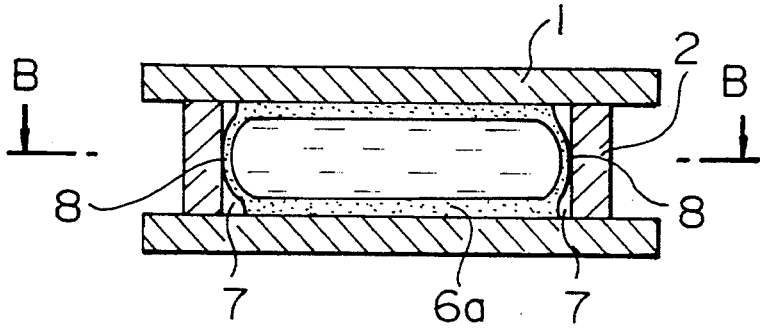
FIG. 2(*b*) is a cross-sectional view along the line A—A of FIG. 2(*a*).
Figure 3A:
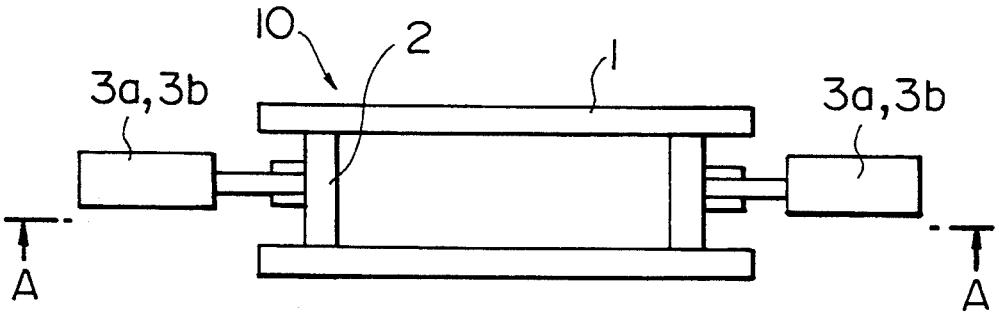
FIG. 3(a) PRIOR ART
FIG. 3(*a*) is a schematic plan view of a width-variable mold used in the continuous slab casting and FIG. 3(*b*) is a cross-sectional view along the line A—A of FIG. 3(*a*).
Figure 3B:
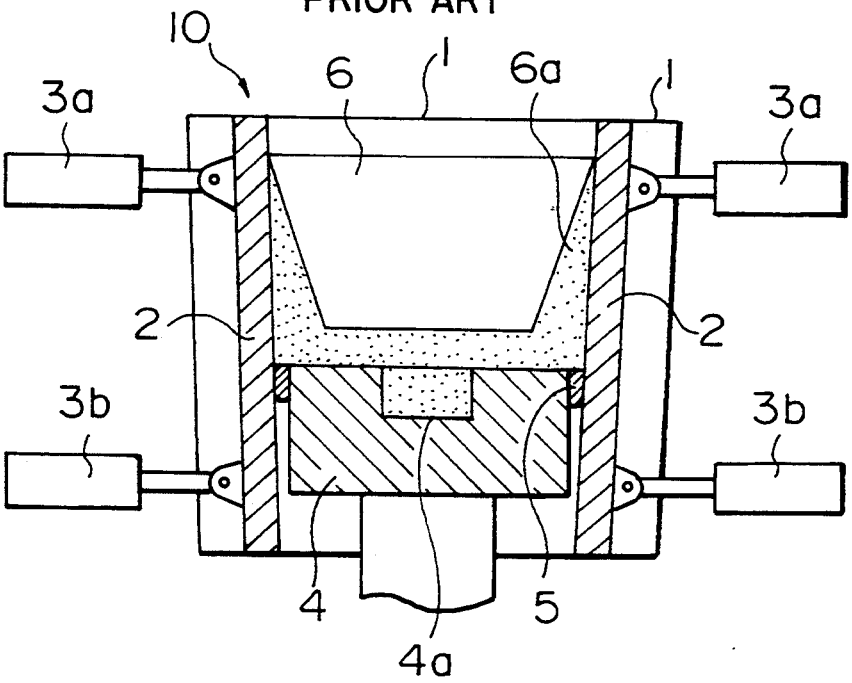
FIG. 3(b) PRIOR ART
Figure 4A:
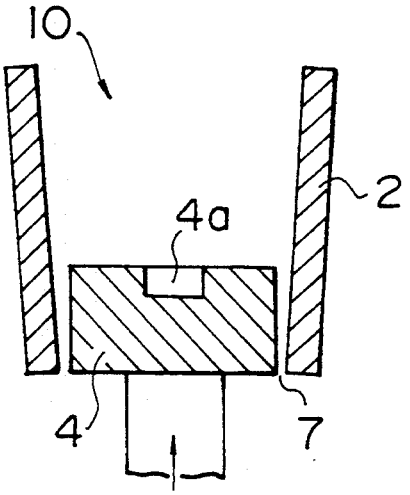
FIG.4(a) PRIOR ART
FIGS. 4(*a*) to 4(*d*) are schematic vertical cross-sectional views showing one example of operating procedure according to the conventional method for starting continuous slab casting, where FIG. 4(*a*) is a view showing that a dummy bar 4 is inserted into a mold 10.
Figure 4B:
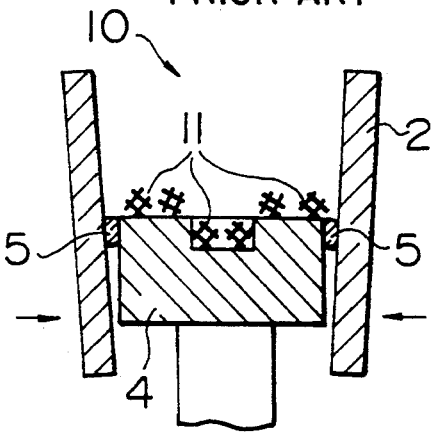
FIG.4(b) PRIOR ART
Figure 4C:
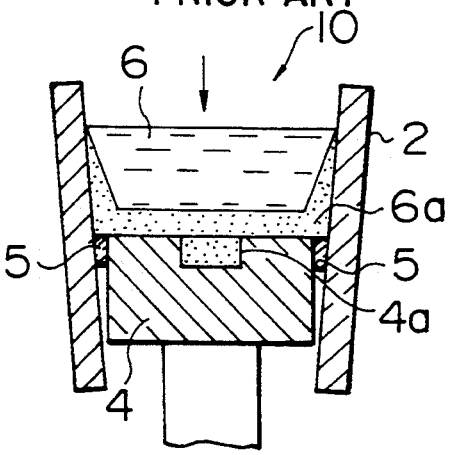
FIG.4(c) PRIOR ART
Figure 4D:
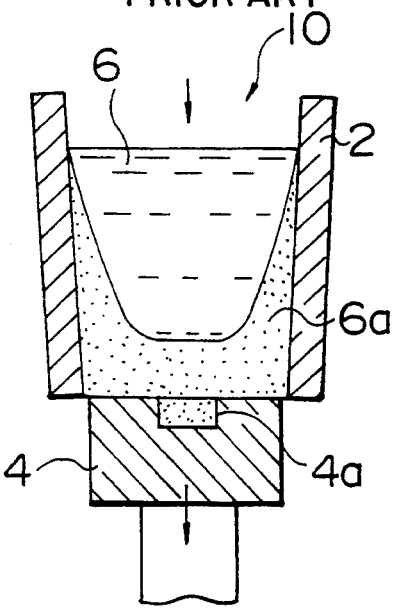
FIG.4(d) PRIOR ART

(2) As shown in FIGS. 2(*a*) and 2(*b*) [FIG. 2(*a*) is a schematic vertical cross-sectional view along the line B—B of FIG. 2(*b*) showing a state of the slab after the withdrawal of the slab is started by using a mold according to the present invention in case that the start to give the downwardly tapered profile is made too late after the withdrawal is started, and FIG. 2(*b*) is a schematic cross-sectional view along the line A—A of FIG. 2(*a*)], there is a possibility such that when the start to withdraw is made too late, the solidified shell 6*a* is solidified and shrunk, and thereby the air gap 7 between the solidified shell 6*a* and the lateral side plate 2 becomes larger, and thus the growth of the solidified shell 6*a* becomes poor (the thickness of the solidified shell 6*a* is made thin), and thus the solidified shell 6*a* causes the bulging 8 in the air gap 7 between the solidified shell 6*a* and the lateral side plate 2 due to the pressure of the molten steel or the solidified shell 6*a* causes the bulging 8*a* due to the pressure of the molten steel when the solidified shell 6*a* emerges from the bottom end of the mold 10, and thus the solidified shell 6*a* is broken so that the molten steel leaks out from the shell.

Therefore, while the lateral side plates 2*a* are gradually given a downwardly tapered profile slowlywise about the time when the speed to withdraw the slab is attained after the withdrawal is started, the solidified shell 6*a* is gradually formed.

During the withdrawal of the dummy bar 4, the solidified shell 6*a* continuously grows, and continuous slab casting is continued after the withdrawal of the dummy bar 4 from the mold 10, thereby forming a slab continuously.

By setting the dummy bar 4 in the mold 10 by adjusting clearances each between the lateral side plates 2 and the dummy bar 4 to 1–3 mm, while maintaining the lateral side plates 2 vertically, filling of sealing materials 5 can be facilitated, whereby a decrease in the preparatory time for casting and automation of filling operation of sealing materials 5 can be promoted.

When continuous casting is carried out by setting the dummy bar 4 in the mold 10, while maintaining clearances of 1–3 mm each between the lateral side plates 2 and the dummy bar 4, no abnormal sliding force appears between the dummy bar 4 or the solidified shell 6*a* and the mold 10 during the passage of the dummy bar 4 through the bottom end of the mold 10. That is, the withdrawal of the dummy bar 4 or the solidified shell 6*a* can be carried out with a small pulling force.

That is, the present invention can prevent break-out due to breakage of the solidified shell 6*a* at the withdrawal and can attain a decrease in the preparatory time for continuous casting, an increase in the rate of operation and the life of molds, and furthermore can shorten the holding time in the mold 10 and reduce the amount of the cooling materials, resulting in reduction in the casting time and operating cost, while ensuring the automation of the casting operations.

PREFERRED EMBODIMENTS OF THE INVENTION

The present invention will be explained in detail below, referring to embodiments of the present invention.

EXAMPLE

Molten steel comprising 0.04 wt. % of C, 0.25 wt. % of Mn, 0.010 wt. % of S, 0.015 wt. % of P, and 0.050 wt. % of sol. Al the balance being Fe and inevitable impurities was poured at a temperature of 1560° C. into a mold. Cast slab, 1920 mm in width and 250 mm in thickness was produced at withdrawal rates of 0.4 m/min in the initial period and 1.6 m/min in the stationary state.

In the production of the cast slab, operational steps for starting to cast a slab, 1,900 mm in width (in terms of the size in cold state) are given below:

(1) To set the distance between the lateral side plates of the mold to 1,967 mm, a distance 50 mm larger than the width of a dummy bar, 1,917 mm.

(2) To insert the dummy bar into the mold and set it to a desired level [a position of 500 mm distant from the top end of the mold having a depth of 0.9 m (900 mm) in the mold].

(3) To set the lateral side plates apart to a distance of 1,920 mm, while maintaining the lateral side plates vertically, so that the clearance each between the lateral side plates and the dummy bar can be 1.5 mm.

(4) To seal the clearances between the dummy bar and the mold.

(5) To set cooling materials, for example, steel chips, articles made up of iron plates or iron rods by welding, etc.

(6) To start to pour molten steel into the mold from a tundish.

(7) To elevate the surface level of poured molten steel in the mold after the start to pour molten steel, so as to obtain a necessary minimum holding time for forming satisfactorily solidified shell, and start to withdraw the dummy bar when the surface level of poured molten steel reaches a desired level (a position of 100 to 150 mm distant downward from the top end of the mold).

(8) To make the top ends of the lateral side plates horizontally more apart by pairs of width-varying units after the start to withdraw the dummy bar to give a downwardly tapered profile of a desired taper ratio (if required, a width of the slab also) to the lateral side plates.

As shown in FIG. 1(*d*), a taper ratio $T_A$ (%/m) can be defined by the following formula (I):

$$T_A\,(\%/\mathrm{m}) = \frac{L_{d2}\,(\mathrm{mm}) - L_{d1}\,(\mathrm{mm})}{L_{d1}\,(\mathrm{mm}) \times L_{d0}\,(\mathrm{m})} \times 100 \qquad (1)$$

wherein $T_A$: taper ratio (%/m)

$L_{d0}$: mold depth (lateral side plate length) (m)

$L_{d1}$: distance (interval) between lateral side plates at the bottom end of the mold (mm)

$L_{d2}$: distance (interval) between lateral side plates at the top end of the mold (mm)

In the step (8), the distance between the top ends of the lateral side plates, i.e. the width of the mold top end, is set to, for example, 1,937 mm in a taper ratio $T_A$ of 0.98%/m by tilting the top ends of the lateral side plates by pairs of width-varying units (for example, oil-hydraulic cylinders) provided at upper and lower levels of the lateral side plates, while maintaining the distance $L_{d1}$ between the bottom ends of the lateral side plates, i.e. the width of the mold bottom end constant at 1,920 mm, where the length $L_{d0}$ of the lateral side plates, i.e. the depth of the mold is 0.9 m, when the satisfactorily solidified shell is formed and no more poured molten steel is passed into the clearances between the solified shell 6*a* and the lateral side plates 2 (for example, 60 seconds after the start to withdraw the dummy bar, or after the passage of the dummy bar through the bottom end of the mold).

As a result of operations according to the foregoing steps (1) to (8), it was found that the present invention was distuiguished over the conventional method in the shortening of the preparatory time, prolongation of mold life, decrease in occurrence of accidents at the start of casting, etc., as shown in Table 1.

For example, in the case of the steel species and withdrawal rates described in the Example, a preferable range for the taper ratio (%/m) of the present invention can be repesented by the following formula (2):

$$0.5\%/m \leqq T_A \leqq 2\%/m \qquad (2)$$

Effects of the present invention are summarized in Table 2.

In Table 1, the term "Preparatory time" means a time required for inserting the dummy bar into the mold, setting it to a desired level and completing the sealing operation (including the operation for setting the cooling materials).

TABLE 1

| | Start of casting by the present invention | | | Start of casting by the conventional method | | |
|---|---|---|---|---|---|---|
| | At insertion of dummy bar (A) | At the start of withdrawing the dummy bar (B) | After the start of withdrawing of dummy bar (C) | At insertion of dummy bar | At the start of withdrawing the dummy bar | After the start of withdrawing of dummy bar |
| Mold top end width | 1,967 | 1,920 | 1,937 | 1,937 | 1,937 | 1,937 |
| Mold bottom end width | 1,967 | 1,920 | 1,920 | 1,920 | 1,920 | 1,920 |

TABLE 1-continued

| | | Start of casting by the present invention | | | Start of casting by the conventional method | | |
|---|---|---|---|---|---|---|---|
| | | At insertion of dummy bar (A) | At the start of withdrawing the dummy bar (B) | After the start of withdrawing of dummy bar (C) | At insertion of dummy bar | At the start of withdrawing the dummy bar | After the start of withdrawing of dummy bar |
| Taper ratio (%/m) | | 0 | 0 | 0.98 | 0.98 | 0.98 | 0.98 |
| Dummy bar width | | 1,917 | 1,917 | 1,917 | 1,900 | 1,900 | 1,900 |
| Evaluation | Preparatory time | | 2 minutes | | | 10 minutes | |
| | mold life | | 500 charges | | | 200 charges | |
| | Occurrence of accidents at the start | | zero occurrence/year | | | 10 occurrences/year | |

TABLE 2

| | | The present invention | Conventional method | Effects |
|---|---|---|---|---|
| 1 | Shortening of holding time at the start of casting (Start to pour molten steel and start to withdraw dummy bar) | 15 seconds | 30–90 seconds | 1) Increase in capacity |
| 2 | Shortening of preparatory time (Sealing application time) [In case of application by workers] | 3 minutes | 10 minutes | 1) Increase in capacity 2) Decrease in work load |
| | Shortening of preparatory time (Sealing application time) [In case of application by robot] | 2 minutes | 10 minutes | 1) Increase in capacity 2) Reduction in investment |
| 3 | Saving of sealing materials and cooling materials | 2000 yen/run | 4800 yen/run | 1) Cost reduction |
| 4 | Prolongation of lateral side plate life (Ni-plated plates) | 500 charges | 200 charges | 1) Cost reduction |
| 5 | Decrease in occurrence of accidents at the start to cast (per slab continuous casting unit) | 0 run/year | 10 runs/ year | 1) Increase in capacity 2) Maintenance cost reduction |

Particularly distinguished effect of the present method for starting to cast shown in Table 2, are shortening of holding time at the start, shortening of preparatory time, saving of sealing materials and cooling materials, prolongation of lateral side plate life, and reduction in occurrence of accidents at the start of casting.

Particularly distinguished effects of the present method for setting a dummy bar, shown in Table 2, are shortening of preparatory time, saving of sealing materials and cooling materials, and reduction in occurrence of accidents at the start of casting.

As explained above, according to the present method for starting to cast a slab continuously, the clearances each between the lateral side plates and the dummy bar are adjusted to 1–3 mm while maintaining the lateral side plates vertically, and continuous casting is started, and thus no abnormal sliding force develops between the formed, solidified shell and the mold and the dummy bar can be withdrawn by a small pulling force and the break-out due to breaking of the shell can be prevented. That is, occurrence of accidents at the start of casting can be prevented and the rate of operation and the mold life can be increased. Furthermore, reduction in the preparatory time for casting in the mold, saving of cooling materials and reduction in the casting time and operating cost can be attained together with automation of the casting operations.

According to the present method for setting a dummy bar in a mold, clearances each between the lateral side plates and the dummy bar are adjusted to 1–3 mm, while maintaining the lateral side plates vertically, and then sealing materials are filled into the clearances, and thus filling of the sealing materials can be carried out easily and when continuous slab casting is carried out by setting the dummy bar as above, the same effects as above can be also obtained.

What is claimed is:

1. A method for starting continuous slab casting in a continuous casting mold, where lateral side plates of the mold are pinched by longitudinal side plates of the mold and are adjustable in the slab width direction, which comprises setting a dummy bar in the mold to a desired level at the center in the vertical direction of the mold, maintaining the lateral side plates vertically, then filling sealing materials into the clearances among the longitudinal side plates, the lateral side plates and the dummy bar, then starting to pour molten steel into the mold, holding the poured molten steel therein, while cooling the molten steel, thereby forming a solidified shell, then starting to withdraw the dummy bar downwardly, making the top ends of the lateral side plates more apart outwardly when no more molten steel passes into the clearances between the formed, solidified shell and the plates, while withdrawing the dummy bar downwardly, thereby giving a downwardly tapered profile to the lateral side plates and conducting continuous casting of the molten steel.

2. A method according to claim 1, wherein the top ends and bottom ends of the lateral side plates are made more apart outwardly, thereby giving a downwardly tapered profile to the lateral side plates.

3. A method according to claim 1, wherein the clearances each between the lateral side plates and the dummy bar are adjusted to 1–3, while maintaining the lateral side plates vertically, and the clearances each between the longitudinal side plates and the dummy bar are adjusted to 2–5 mm.

4. A method according to claim 1, wherein a holding time at the start to cast from the start to pour molten steel till the start to withdraw the dummy bar is 10 to 30 seconds.

5. A method according to claim 4, wherein the holding time at the start to cast from the start to pour molten steel till the start to withdraw the dummy bar is about 15 seconds.

6. A method according to claim 1, wherein when the top end of the dummy bar proceeds downwardly to a position about 1/5 of the mold depth up from the bottom end of the mold or lower after the start to withdraw the dummy bar, the top ends of the lateral side plates start to be made more apart outwardly, thereby giving a downwardly tapered profile to the lateral side plates, and conducting the continuous casting.

7. A method according to claim 6, wherein the top ends and bottom ends of the lateral side plates start to be made more apart outwardly, thereby giving a downwardly tapered profile to the lateral side plates.

8. A method according to claim 6, wherein after the start to withdraw the dummy bar and after the passage of the top end of the dummy bar through the bottom end of the mold, the top ends of the lateral side plates start to be made more apart outwardly, thereby giving a downwardly tapered profile to the lateral side plates, and conducting the continuous casting.

9. A method according to any one of claim 1, wherein on and after 30 seconds after the start to withdraw the dummy bar, the top ends of the lateral side plates start to be made more apart outwardly, thereby giving a downwardly tapered profile to the lateral side plates, and conducting the continuous casting.

10. A method according to claim 9, wherein the top ends and bottom ends of the lateral side plates start to be made more apart outwardly, thereby giving a downwardly tapered profile to the lateral side plates.

11. A method according to claim 9, wherein after 60 seconds after the start to withdraw the dummy bar, the top ends of the lateral side plates start to be made more apart outwardly, thereby giving a downwardly tapered profile to the lateral side plates, and conducting the continuous casting.

12. A method according to claim 1, wherein in view of slab heat shrinkage occurring usually in the stationary casting state, the top ends of the lateral side plates are made more apart outwardly by about 1%/m of the full distance (the interval) between the lateral side plates, corresponding to the slab heat shrinkage, thereby giving a downwardly tapered profile to the lateral side plates.

13. A method according to claim 1, wherein after the start to withdraw the dummy bar, the top ends of the lateral side plates of the mold are made more apart outwardly to give a downwardly tapered profile to the lateral side plates in such a mode that a taper ratio $T_A$ represented by the following formula (1) satisfies the following formula (2), and conducting the continuous casting:

$$T_A\,(\%/\mathrm{m}) = \frac{L_{d2}\,(\mathrm{mm}) - L_{d1}\,(\mathrm{mm})}{L_{d1}\,(\mathrm{mm}) \times L_{d0}\,(\mathrm{m})} \times 100 \qquad (1)$$

wherein $T_A$: taper ratio (%/m)

$L_{d0}$: mold depth (lateral side plate length) (m)

$L_{d1}$: distance (interval) between lateral side plates at the bottom end of the mold $L_{d2}$: distance (interval) between lateral side plates at the top end of the mold (mm)

$$0.5\%/m \leqq T_A \leqq 2.08\%/m \qquad (2).$$

14. A method according to claim 1, wherein the desired level at the center in the vertical direction of the mold, to which level the dummy bar is set in the mold, is a position by $\frac{1}{3}$–$\frac{1}{2}$ of mold depth distant from the bottom end of the mold.

15. A method according to claim 1, wherein the distance between the lateral side plates is adjusted to at least 10 mm larger at each side than the width of the dummy bar, and then the dummy bar is set in the mold to a desired level at the center in the vertical direction of the mold.

16. A method according to claim 15, wherein the distance between the lateral side plates is adjusted to 25–45 mm larger at each side than the width of the dummy bar, and then the dummy bar is set in the mold to a desired level at the center in the vertical direction of the mold.

17. A method for starting continuous slab casting in a continuous casting mold, where lateral side plates of the mold are pinched by longitudinal side plates of the mold and are adjustable in the slab width direction, which comprises adjusting a distance between the lateral side plates to a size at least 10 mm larger at each side than a width of a dummy bar; then inserting the dummy bar into the mold from the upper or lower side of the mold, and setting the dummy bar in the mold to a desired level at the center in the vertical direction of the mold; then adjusting the clearances each between the lateral side plates and the dummy bar to 1–3 mm, while maintaining the lateral side plates vertically, and adjusting the clearances each between the longitudinal side plates and the dummy bar to 2–5 mm; then filling sealing materials into the clearances among the longitudinal side plates, the lateral side plates and the dummy bar; then starting to pour molten steel into the mold, and holding the poured molten steel in the mold for a time from 10 to 30 seconds, while cooling the molten steel, thereby forming a solidified shell; and then starting to withdraw the dummy bar, and starting making the top ends of the lateral side plates more apart outwardly when the top end of the dummy bar proceeds downwardly to a position about 1/5 of the mold depth up from the bottom end of the mold or lower, and making the top ends of the lateral side plates more apart outwardly while withdrawing the dummy bar downwardly, thereby giving a downwardly tapered profile to the lateral side plates in such a mode that a taper ratio $T_A$ represented by the following formula (1) satisfies the following formula (2), and conducting the continuous casting:

$$T_A\ (\%/\mathrm{m}) = \frac{L_{d2}\ (\mathrm{mm}) - L_{d1}\ (\mathrm{mm})}{L_{d1}\ (\mathrm{mm}) \times L_{d0}\ (\mathrm{m})} \times 100 \quad (1)$$

wherein $T_A$: taper ratio (%/m)

$L_{d0}$: mold depth (lateral side plate length) (m)

$L_{d1}$: distance (interval) between lateral side plates at the bottom end of the mold (mm)

$L_{d2}$: distance (interval) between lateral side plates at the top end of the mold (mm)

$$0.5\%/m \leqq T_A \leqq 2.0\%/m \quad (2).$$

18. A method according to claim 17, wherein it is started that the top ends and bottom ends of the lateral side plates are made more apart outwardly, thereby giving a downwardly tapered profile to the lateral side plates.

19. A method for starting continuous slab casting in a continuous casting mold, where lateral side plates of the mold are pinched by longitudinal side plates of the mold and are adjustable in the slab width direction, which comprises adjusting a distance between the lateral side plates to a size at least 10 mm larger at each side than a width of a dummy bar; then inserting the dummy bar into the mold from the upper or lower side of the mold, and setting the dummy bar in the mold to a desired level at the center in the vertical direction of the mold; then adjusting the clearances each between the lateral side plates and the dummy bar to 1–3 mm, while maintaining the lateral side plates vertically, and adjusting the clearances each between the longitudinal side plates and the dummy bar to 2–5 mm; then filling sealing materials into the clearances among the longitudinal side plates, the lateral side plates and the dummy bar; then starting to pour molten steel into the mold, and holding the poured molten steel in the mold for a time from 10 to 30 seconds, while cooling the molten steel, thereby forming a solidified shell; and then starting to withdraw the dummy bar, and starting making the top ends of the lateral side plates more apart outwardly after 60 seconds after the start to withdraw the dummy bar, and making the top ends of the lateral side plates more apart outwardly while withdrawing the dummy bar downwardly, thereby giving a downwardly tapered profile to the lateral side plates in such a mode that a taper ratio $T_A$ represented by the following formula (1) satisfies the following formula (2), and conducting the continuous casting:

$$T_A\ (\%/\mathrm{m}) = \frac{L_{d2}\ (\mathrm{mm}) - L_{d1}\ (\mathrm{mm})}{L_{d1}\ (\mathrm{mm}) \times L_{d0}\ (\mathrm{m})} \times 100 \quad (1)$$

wherein $T_A$: taper ratio (%/m)

$L_{d0}$: mold depth (lateral side plate length)(m)

$L_{d1}$: distance (interval) between lateral side plates at the bottom end of the mold (mm)

$L_{d2}$: distance (interval) between lateral side plates at the top end of the mold (mm)

$$0.5\%/m \leqq T_A 2.0\%/m \quad (2).$$

20. A method according to claim 19, wherein it is started that the top ends and bottom ends of the lateral side plates are made more apart ourwardly, thereby giving a downwardly tapered profile to the lateral side plates.

21. A method for setting a dummy bar prior to the start of casting of continuous slab casting, wherein lateral side plates of the mold are pinched by longitudinal side plates of the mold and are adjustable in the slab width direction, which comprises adjusting a distance between the lateral side plates to a size at least 10 mm larger at each side than a width of a dummy bar; then inserting the dummy bar into the mold from the upper or lower side of the mold, and setting the dummy bar in the mold to a desired level at the center in the vertical direction of the mold; then maintaining the lateral side plates vertically, and adjusting the clearances each between the lateral side plates and the dummy bar to 1–3 mm; then filling sealing materials into the clearances among the longitudinal side plates, the lateral side plates and the dummy bar, thereby setting the dummy bar in the continuous slab casting mold.

22. A method according to claim 21, wherein the desired level at the center in the vertical direction of the mold, to which level the dummy bar is set in the mold, is a position $\frac{1}{3}$–$\frac{1}{2}$ of mold depth distant from the bottom end of the mold.

23. A method according to claim 21, wherein the distance between the lateral side plates is adjusted to 25–45 mm larger at each side than the width of the dummy bar, and then the dummy bar is set in the mold to a desired level at the center in the vertical direction of the mold.

24. A method according to claim 21, wherein clearances each between the lateral side plates and the dummy bar are adjusted to 1–3 mm, while maintaining the lateral side plates vertically, and clearances between the dummy bar and the longitudinal side plates are adjusted to 2–5 mm.

* * * * *

UNITED STATES PATENT AND TRADEMARK OFFICE

CERTIFICATE OF CORRECTION

PATENT NO. : 5,335,716

DATED : Aug. 9, 1994

INVENTOR(S) : Hiromichi TAKESUE et al.

It is certified that error appears in the above-indentified patent and that said Letters Patent is hereby corrected as shown below:

Col. 11, line 13, after "1-3", insert --mm--.

Col. 12, line 22, change "2.08%" to --2.0%--.

Col. 14, line 14, after "$T_A$", insert -- $\leqq$ --.

Signed and Sealed this

Eighth Day of November, 1994

Bruce Lehman

*Attest:*

BRUCE LEHMAN

*Attesting Officer*

*Commissioner of Patents and Trademarks*